US007673404B2

(12) United States Patent
Guohong

(10) Patent No.: US 7,673,404 B2
(45) Date of Patent: Mar. 9, 2010

(54) ELECTRIC STEAM IRON

(75) Inventor: Fang Guohong, Zhouxiang (CN)

(73) Assignee: Yueli Electrical Appliance Co., Ltd., Ningbo, Zhejiang Province (CN)

( * ) Notice: Subject to any disclaimer, the term of this patent is extended or adjusted under 35 U.S.C. 154(b) by 0 days.

(21) Appl. No.: 12/138,004

(22) Filed: Jun. 12, 2008

(65) Prior Publication Data

US 2009/0000162 A1 Jan. 1, 2009

(30) Foreign Application Priority Data

Jun. 29, 2007 (CN) ..... 2007 1 0069805

(51) Int. Cl.
*D06F 75/24* (2006.01)
*D06F 75/26* (2006.01)

(52) U.S. Cl. ..... 38/77.83

(58) Field of Classification Search ..... 38/74, 38/77.7–77.83, 82, 93, 88; 219/245; 417/425.5
See application file for complete search history.

(56) References Cited

U.S. PATENT DOCUMENTS 1,736,148 A * 11/1929 Brewer ..... 38/77.7
1,840,652 A * 1/1932 Bell ..... 219/252
2,345,413 A * 3/1944 Morton ..... 38/77.7
2,350,452 A * 6/1944 Envall ..... 38/77.83
2,387,757 A * 10/1945 Hoecker ..... 38/77.5
2,637,126 A * 5/1953 Fitzsimmons ..... 38/77.83
3,263,350 A * 8/1966 Salomon ..... 38/77.7
4,406,591 A * 9/1983 Louis ..... 417/363
5,010,664 A * 4/1991 Sakano et al. ..... 38/77.7
5,279,054 A * 1/1994 Chasen ..... 38/77.7
6,438,876 B2 * 8/2002 Har et al. ..... 38/77.7
6,953,912 B2 * 10/2005 Alday Lesaga ..... 219/251
7,472,504 B2 * 1/2009 Yu et al. ..... 38/77.8

FOREIGN PATENT DOCUMENTS

CN 2820934 9/2006
WO 2007/085145 8/2007

* cited by examiner

*Primary Examiner*—Ismael Izaguirre
(74) *Attorney, Agent, or Firm*—Richard M. Goldberg

(57) ABSTRACT

An electric steam iron includes a housing, a water tank within the housing, a bottom plate to which the housing is secured, a heating device in the bottom plate for heating the bottom plate, a boiling chamber inside the bottom plate, and a further independent steam boiler above the bottom plate, and having an inlet in fluid communication with the water tank and an outlet in fluid communication with the inlet of the boiling chamber, such that steam from the steam boiler will be supplied to the boiling chamber in the bottom plate and further heated by the high temperature of the bottom plate, so that little drops in the steam will be fully boiled, thereby providing a high purity of the steam sprayed out of the bottom plate.

18 Claims, 5 Drawing Sheets

ELECTRIC STEAM IRON

BACKGROUND OF THE INVENTION

The present invention relates generally to electric irons for use in the home, and more particularly, to a more efficient electric steam iron.

Known electric steam irons mainly comprise a housing, a water tank, a bottom plate and a heating device which is used to heat the bottom plate. A boiling chamber is provided inside the bottom plate, whereby the water can be heated up and boiled by the bottom plate, so that the boiling chamber in the bottom plate forms a steam generator. When the iron is working, the water in the boiling chamber is heated by the bottom plate and turns to steam, and this can then be sprayed out from the steam outlet of the bottom plate to iron the clothing. However, since there is only one steam generator in the known electric steam iron, and the area of the bottom plate and the power of the iron are limited, the temperature is also variational, so that the efficiency of the generating steam is very limited. Specifically, the water cannot be fully boiled, which leads to the steam being sprayed out from the bottom plate including many drops. This phenomenon exists in conventional electric steam irons that people currently use.

SUMMARY OF THE INVENTION

It is an object of the present invention to provide an electric steam iron which has an improved boiling effect of water, and which can produce more steam with more pressure, to assure a good ironing effect.

For achieving this object, the electric steam iron of the present invention comprises a housing, a water tank, a bottom plate and a heating device which is used to heat the bottom plate, as well as a boiling chamber which is set inside the bottom plate. However, in addition, there is an independent steam boiler above the bottom plate. The inlet of the steam boiler is in fluid communication with the water tank, and the outlet of the steam boiler is in fluid communication with the inlet of the boiling chamber inside the bottom plate.

The steam boiler and the boiling chamber inside the bottom plate respectively form first and second steam generators of the electric steam iron of the present invention. While the heating devices used to heat the bottom plate and the steam boiler can be any type of existing heater, in order to make the structure simpler and to assure the efficiency of generating steam of the first and second steam generators, the heating device in the bottom plate and the heating device in the steam boiler can be an electrothermal tube or a PTC (Positive Temperature Coefficient) heater.

In order to improve the effect of boiling water of these two steam generators, a winding water passage which winds back and forth can be provided in the boiling chamber and the steam boiler. By increasing the distance the water must pass, the area of the water touching the steam generators is increased as well, so that the effect of boiling of the water can be improved.

In order to make a further improvement of the effect of boiling of the water, a plurality of barrier pieces can be provided on the inner walls of each water passage, to further increase the area of the water touching the steam generators.

Sometimes, impurities in the water may block the water passage, and if the steam inside the steam boiler cannot be output normally, the pressure inside the boiler becomes greater and greater, and this can be very dangerous. In order to make the steam boiler much safer, a safety valve is provided on the steam boiler, generally, on the bottom of the steam boiler. In case the pressure inside the steam boiler accidently becomes too great, the superfluous steam inside the steam boiler can be directly output through the safety valve. This makes the electric iron much safer to use.

The steam boiler is independent of the bottom plate and is not effected by the temperature of the bottom plate. It is better for the steam boiler to be completely segregated from the bottom plate. Further, there is a heat insulation cover which covers the steam boiler to segregate the steam boiler. Because of this arrangement, the steam boiler will achieve better heat insulation segregated from the bottom plate. This will reduce the interaction of these two devices, and prevent the great heat of the steam boiler from transferring to other devices in the iron. This will also reduce the temperature of the housing of the iron and the user will not be scalded when using it.

In order to better control the infusion of the water in the water tank to the steam boiler, an electromagnetic pump is provided. The inlet of the electromagnetic pump is in fluid communication with the water tank, and the outlet of the electromagnetic pump is in fluid communication with the inlet of the steam boiler. The water in the water tank is thereby input into the steam boiler through the electromagnetic pump. Moreover, a filter tip is provided at the inlet of the electromagnetic pump to filter impurities in the water and to eliminate any bad effect on the electromagnetic pump and two steam generators by the impurities.

Compared with the prior art, in the present invention, there are two independent steam generators in the electric iron. The steam boiler firstly ensures turning most of the water into steam, and then, the steam from the steam boiler will come into the boiling chamber in the bottom plate, where the steam will be further heated by the high temperature of the bottom plate. The little drops in the steam will thereby be fully boiled. This avoids the phenomenon of steam with many drops, and keeps the purity of the steam sprayed out of the bottom plate high, to guarantee the effect of good ironing. The boiling effect of the electric steam iron of the present invention is more ideal, and the steam boiler working independently can generate a great deal of steady steam. Further, the heat insulation cover between the steam boiler and the bottom plate can make the steam boiler independent from the bottom plate so that it is not effected by the temperature of the bottom plate. The structure of the present invention is simple and the actual effect of ironing is excellent, and it is easy to be manufactured.

DETAILED DESCRIPTION

Figure 1:
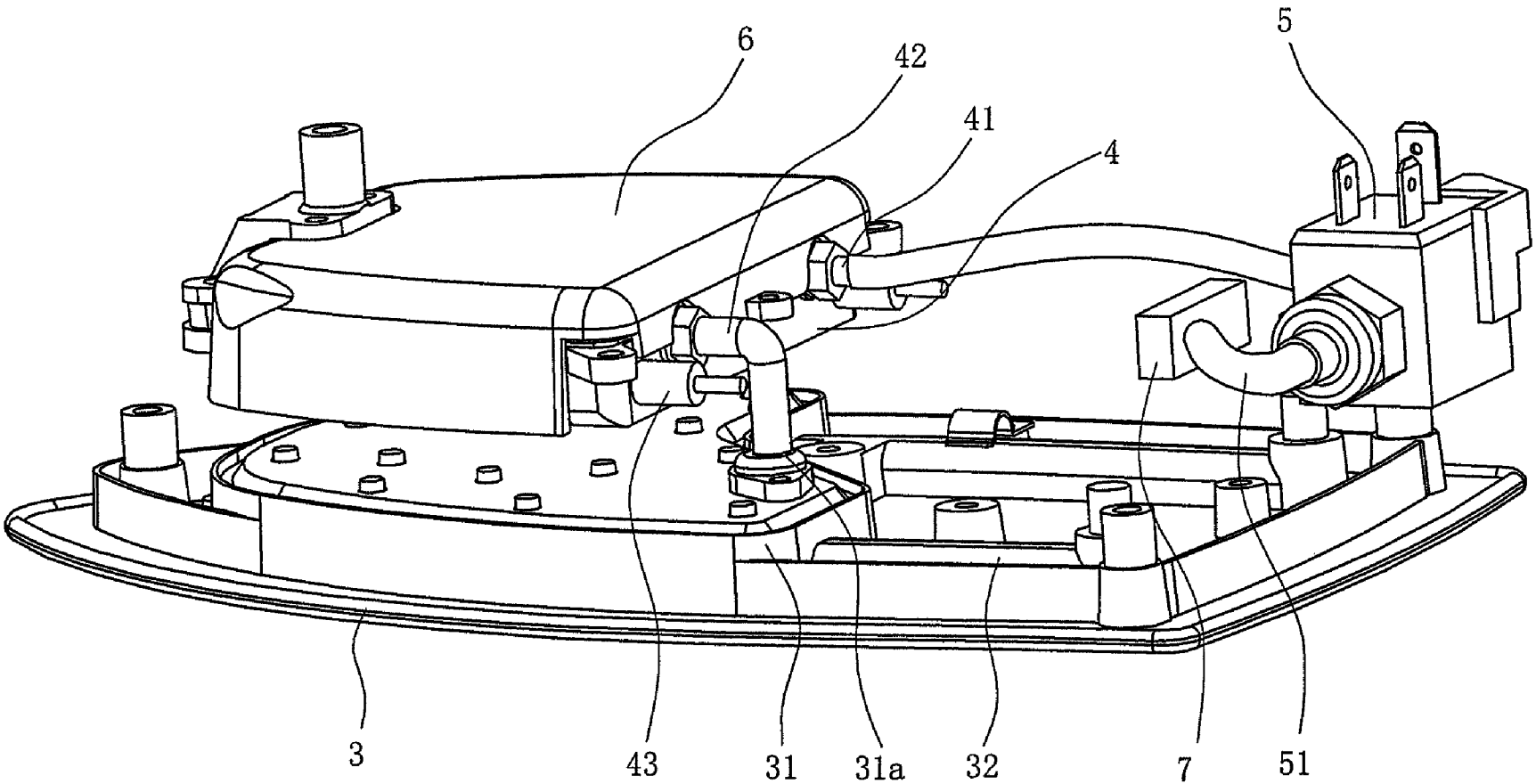
FIG. 1 is a perspective view of the electric steam iron of the present invention, with the housing and some minor devices removed.
Figure 2:
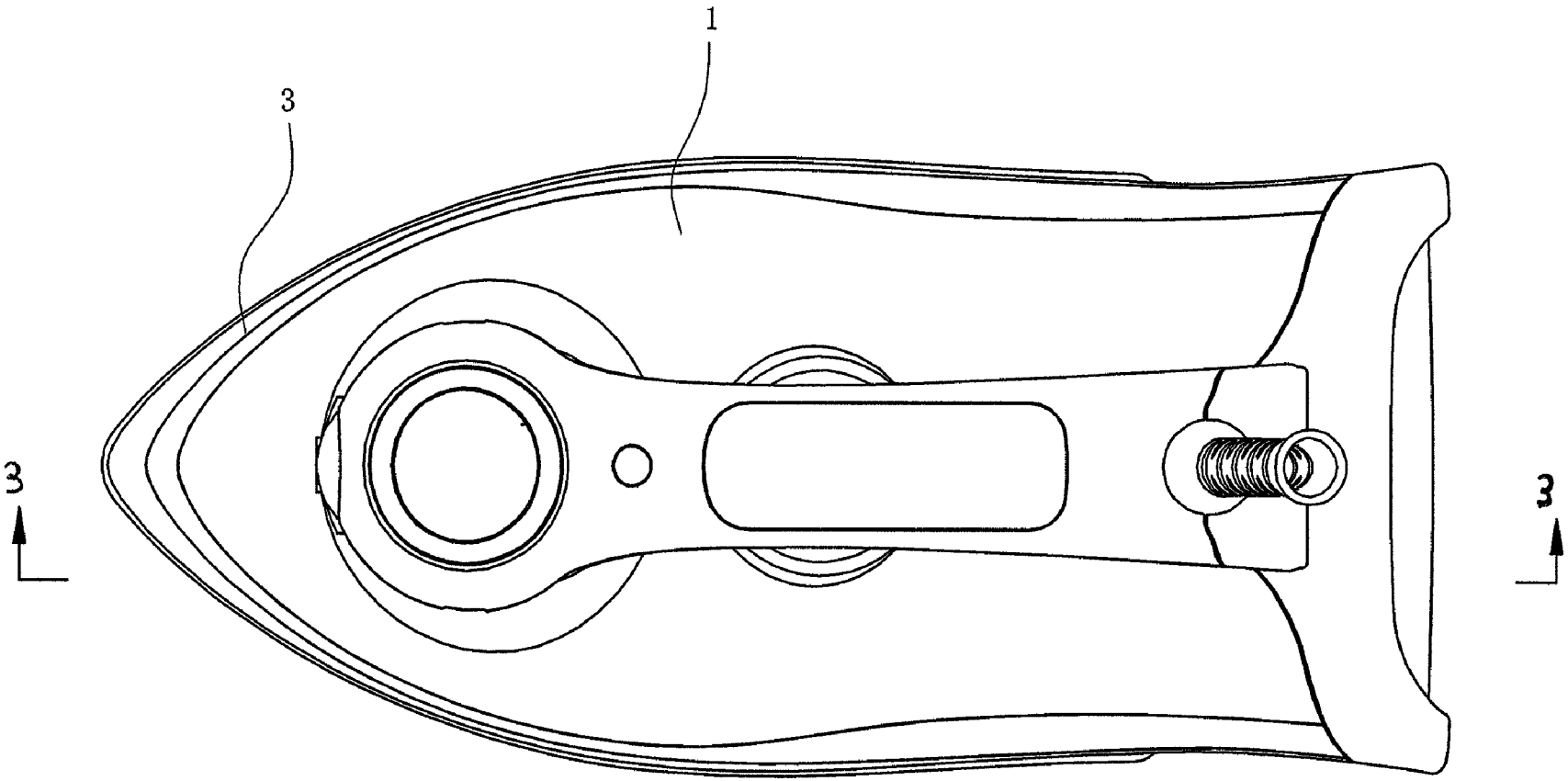
FIG. 2 is a top plan view of the electric steam iron of the invention.

To enable a further understanding of the innovative and technological content of the invention herein, reference is made to the detailed description of the invention and the accompanying drawings below.

FIGS. 1~5 show an embodiment of the present invention. In this embodiment, the electric steam iron comprises a housing (1), a water tank (2), an electromagnetic pump (5), a bottom plate (3) which has a boiling chamber (31) inside it, a heating device (32) which is used to heat the bottom plate (3), and an independent steam boiler (4) above the bottom plate (3).

Figure 3:
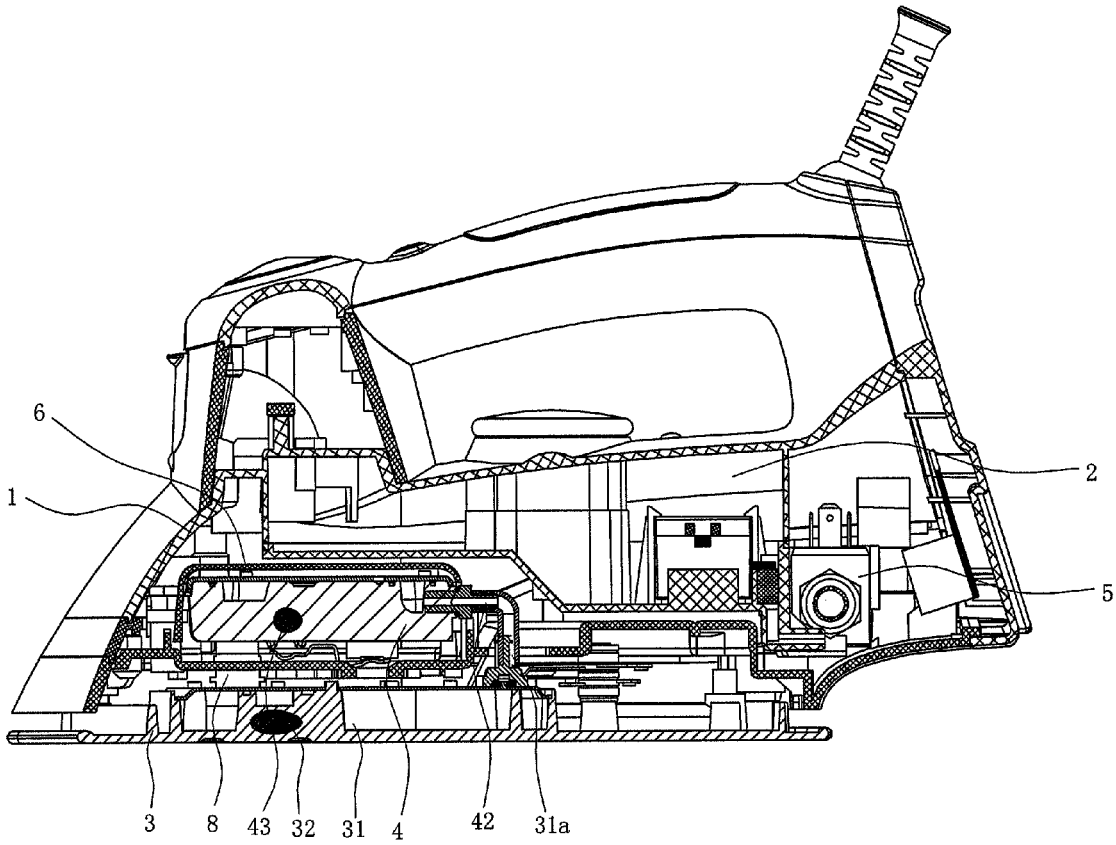
FIG. 3 is a sectional view the electric steam iron of FIG. 2, taken along line 3-3 thereof.

It will be appreciated from FIGS. 1 and 3 that independent steam boiler 4 is spaced above bottom plate 3 out of contact with bottom plate 3 and boiling chamber 31 thereof. Specifically, independent steam boiler 4 is spaced above bottom plate 3 with an air gap therebetween and with no contacting walls therebetween.

The housing (1) is made up of a thin plate or many pieces of lamella as required by the actual manufacture. The water tank (2) is enclosed within the housing (1), and is formed as a closed chamber at a position higher than bottom plate (3) and steam boiler (4). This is similar to an existing open-style electric steam iron.

The water tank (2) is in fluid communication with the inlet (41) of the steam boiler (4) via the electromagnetic pump (5). Specifically, the inlet (51) of the electromagnetic pump (5) is in fluid communication with the water tank (2), and the outlet of the electromagnetic pump (5) is in fluid communication with the inlet (41) of the steam boiler (4). The electromagnetic pump (5) can be directly fixed on the housing (1). To avoid any impurities from entering into the water passage, a filter tip (7) is provided at the inlet (51) of the electromagnetic pump (5).

The outlet (42) of the steam boiler (4) is in fluid communication with the inlet (31*a*) of the boiling chamber (31) inside the bottom plate (3).

A safety valve (8), which is in fluid communication with the steam boiler (4), protects the steam boiler (4) from heavy pressure and renders the product safer to use. The safety valve (8) is provided on the bottom of the steam boiler (4).

A heat insulation cover (6) covers the steam boiler (4), and thereby segregates the steam boiler (4) from other elements of the device and has a heat insulation effect.

Figure 4:
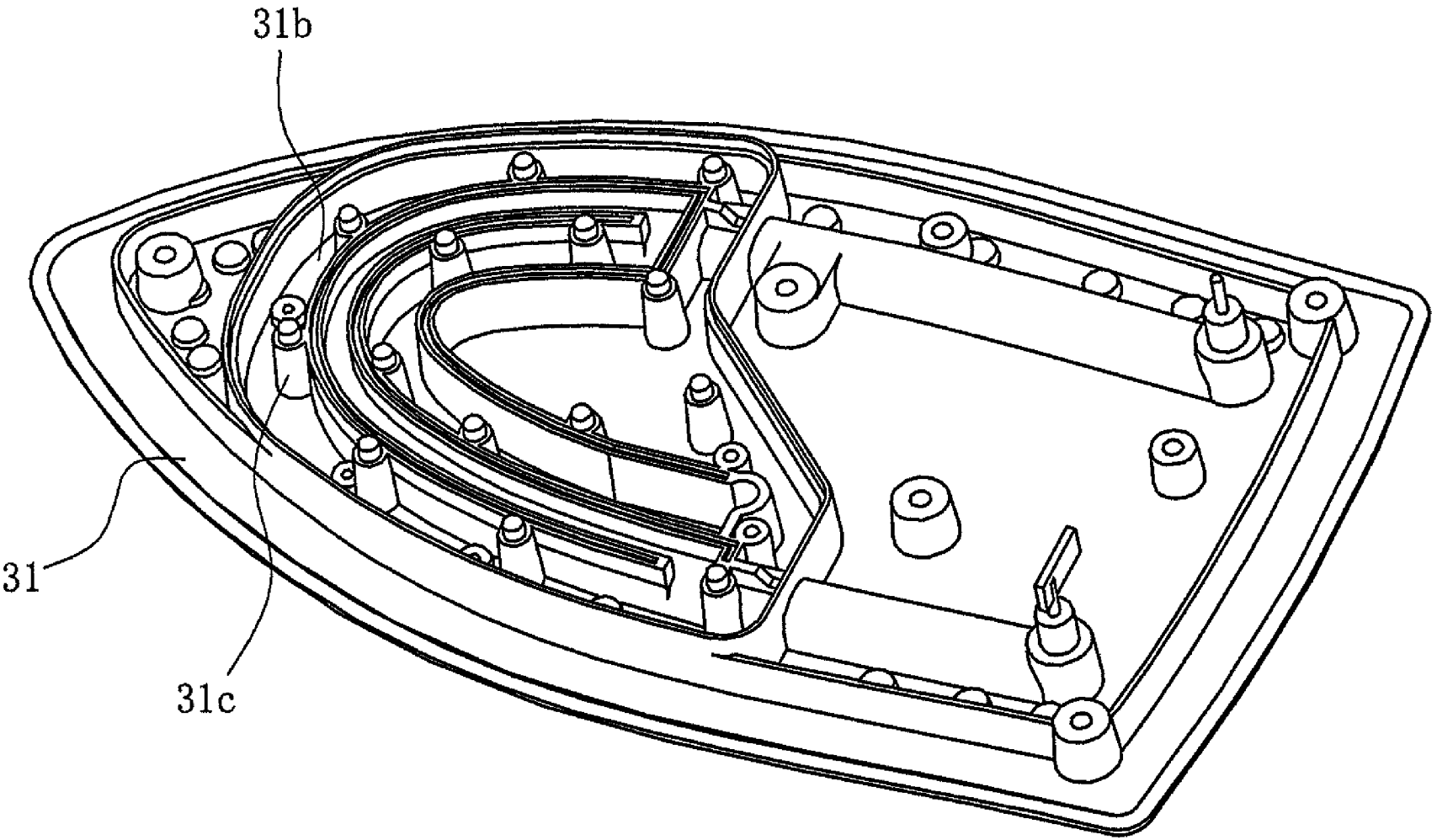
FIG. 4 is a perspective view of the steam boiler of the present invention, with the cover of the steam boiler removed.
Figure 5:
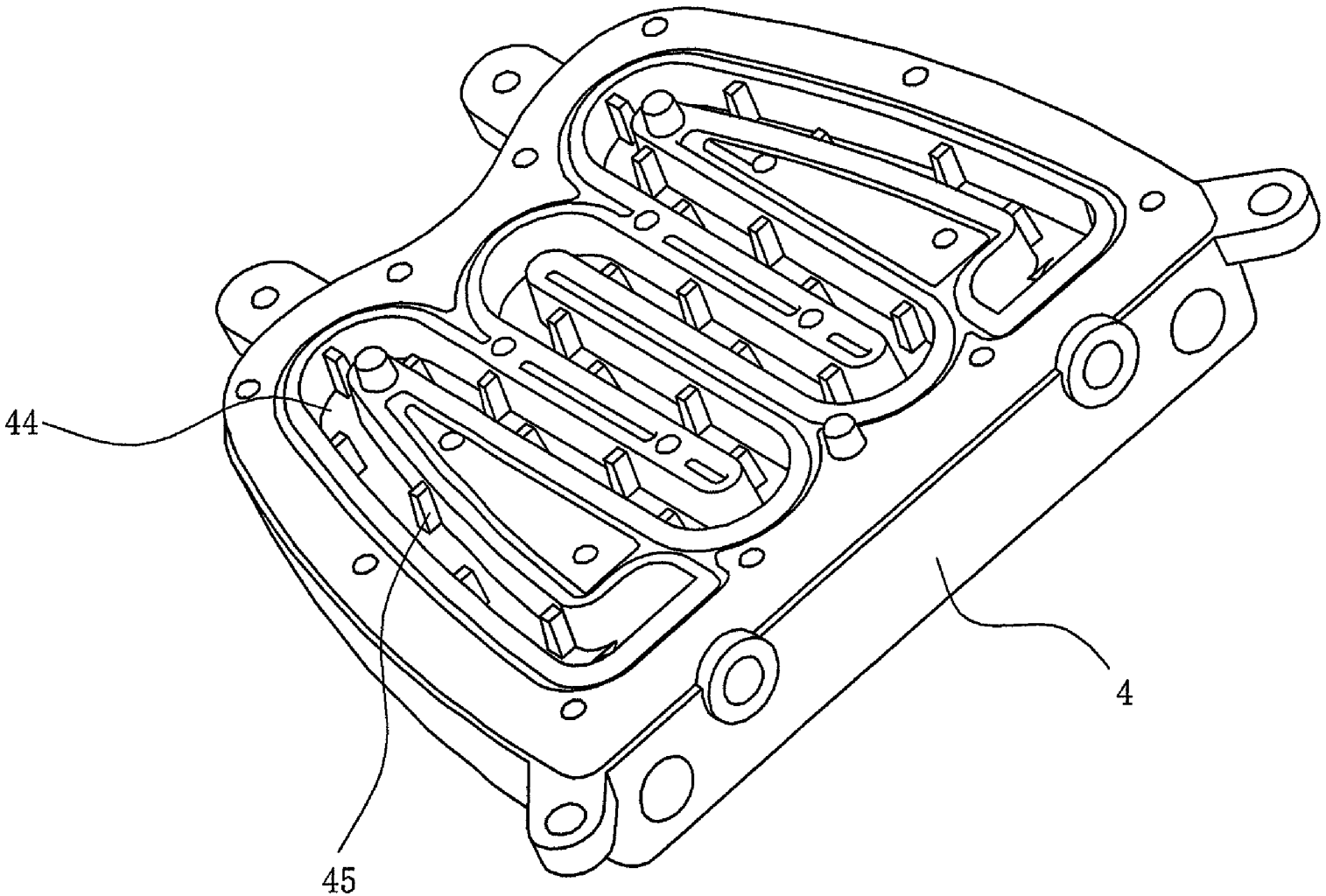
FIG. 5 is a perspective view of the bottom plate of the present invention, with the cover of the boiling chamber removed.

The boiling chamber (31) and the steam boiler (4) are each provided with a winding water passage (31*b*, 44) winding back and forth. There are a plurality of barrier pieces (31*c*) on the inner walls of the water passage (31*b*) of the boiling chamber (31), and there are a plurality of barrier pieces (45) on the inner walls of the water passage (44) of the steam boiler (4), as shown in FIG. 4 and FIG. 5. In this embodiment, to increase the wall area that the water touches, the barrier pieces (31*c*) in the boiling chamber (31) each have a columnar shape.

Both the heating device (32) in the bottom plate (3) and the heating device (43) in the steam boiler (4) are each preferably an electrothermal tube, but may be a PCT (positive temperature coefficient) heater.

What is claimed is:

1. An electric steam iron comprises:

a housing, a water tank within the housing, a bottom plate to which the housing is secured, a heating device in the bottom plate for heating the bottom plate, a boiling chamber inside the bottom plate and having an inlet, and a further independent steam boiler spaced above the bottom plate out of contact with the bottom plate and boiling chamber and with no contacting walls therebetween, and having an inlet in fluid communication with said water tank and an outlet in fluid communication with the inlet of the boiling chamber.

2. An electric steam iron according to claim 1, wherein the steam boiler has a further heating device, and the heating device in the bottom plate and the heating device in the steam boiler are one of the following:

an electrothermal tube and a positive temperature coefficient heater.

3. An electric steam iron according to of claim 1, wherein at least one of said boiling chamber and said steam boiler have a sinuous winding water passage with numerous substantial changes in direction.

4. An electric steam iron according to claim 3, further comprising a plurality of barrier pieces on an inner wall of at least one said water passage.

5. An electric steam iron according to claim 1, wherein the steam boiler further includes a safety valve.

6. An electric steam iron according to claim 1, further comprising a heat insulation cover for the steam boiler.

7. An electric steam iron according to claim 1, further comprising an electromagnetic pump interposed between the water tank and the steam boiler, the electromagnetic pump having an inlet in fluid communication with the water tank and an outlet in fluid communication with the inlet of the steam boiler.

8. An electric steam iron according to claim 7, further comprising a filter at the inlet of the electromagnetic pump.

9. An electric steam iron according to claim 1, wherein said further independent steam boiler is spaced above the bottom plate with an air gap therebetween.

10. An electric steam iron comprises:

a housing, a water tank within the housing, a bottom plate to which the housing is secured, a heating device in the bottom plate for heating the bottom plate, a boiling chamber inside the bottom plate and having an inlet, and a further independent steam boiler above the bottom plate, and having an inlet in fluid communication with said water tank and an outlet in fluid communication with the inlet of the boiling chamber, and at least one of said boiling chamber and said steam boiler have a sinuous winding water passage with numerous substantial changes in direction.

11. An electric steam iron according to claim 10, wherein the steam boiler has a further heating device, and the heating device in the bottom plate and the heating device in the steam boiler are one of the following:

an electrothermal tube and a positive temperature coefficient heater.

12. An electric steam iron according to of claim 10, wherein each of said boiling chamber and said steam boiler have a sinuous winding water passage with numerous substantial changes in direction.

13. An electric steam iron according to claim 12, further comprising a plurality of barrier pieces on an inner wall of at least one said water passage.

14. An electric steam iron according to claim 10, wherein the steam boiler further includes a safety valve.

15. An electric steam iron according to claim 10, further comprising a heat insulation cover for the steam boiler.

16. An electric steam iron according to claim 10, further comprising an electromagnetic pump interposed between the water tank and the steam boiler, the electromagnetic pump having an inlet in fluid communication with the water tank and an outlet in fluid communication with the inlet of the steam boiler.

17. An electric steam iron according to claim 16, further comprising a filter at the inlet of the electromagnetic pump.

18. An electric steam iron according to claim 10, further comprising a plurality of barrier pieces on an inner wall of at least one said water passage.

* * * * *